US011091937B1

(12) United States Patent
Studebaker, Jr.

(10) Patent No.: US 11,091,937 B1
(45) Date of Patent: Aug. 17, 2021

(54) CHAIN TAB FOR SECURING GATED ENCLOSURES

(71) Applicant: Robert L. Studebaker, Jr., Tulsa, OK (US)

(72) Inventor: Robert L. Studebaker, Jr., Tulsa, OK (US)

( * ) Notice: Subject to any disclaimer, the term of this patent is extended or adjusted under 35 U.S.C. 154(b) by 750 days.

(21) Appl. No.: 15/898,130

(22) Filed: Feb. 15, 2018

Related U.S. Application Data

(60) Provisional application No. 62/461,542, filed on Feb. 21, 2017.

(51) Int. Cl.
*E04H 17/18* (2006.01)
*E06B 11/02* (2006.01)
*E05B 65/00* (2006.01)

(52) U.S. Cl.
CPC ..... *E05B 65/0007* (2013.01); *E04H 17/18* (2013.01); *E06B 11/02* (2013.01); *E06B 11/021* (2013.01)

(58) Field of Classification Search
CPC ..... E04H 17/16; E04H 17/18; E06B 11/00; E06B 11/02; A01K 3/00; F16G 11/04
See application file for complete search history.

(56) References Cited

U.S. PATENT DOCUMENTS 3,720,431 A * 3/1973 Oliver ..... E05C 19/00 292/264
D237,722 S * 11/1975 Kratky ..... D25/48.5
D239,543 S * 4/1976 Kratky ..... D25/48.5
D244,459 S * 5/1977 Kratky ..... D25/48.5
5,918,896 A * 7/1999 Jenkins, Jr. ..... B60D 1/28 280/457
7,958,616 B2 * 6/2011 Meyer, Jr. ..... A01K 3/00 29/468
8,465,063 B1 * 6/2013 Jones ..... E05B 65/0007 292/264
9,500,000 B2 * 11/2016 McCarty ..... E04H 17/18
2006/0065209 A1 * 3/2006 May ..... A01K 1/0017 119/502

* cited by examiner

*Primary Examiner* — Michael P Ferguson
(74) *Attorney, Agent, or Firm* — Frederic Dorwart, Lawyers PLLC; Penina Michlin Chiu

(57) ABSTRACT

A chain tab for securing gated enclosures. A chain tab includes a pair of funnel-shaped sides that angle inward in a V-shape towards a chain slot. A chain tab system includes a gate including a railing adjacent to a fence post, a chain hanging from the railing, a chain tab secured to the gate proximate to the chain, the chain tab including a pair of sides meeting at a corner, a slot extending into the chain tab towards the corner, the slot dividing the chain tab into two obtuse triangles connected together at the corner, the first obtuse triangle including an acclivous side funneling into the slot, and the second obtuse triangle including a declivous side funneling into the slot, wherein the chain wraps around the fence post and slides along the acclivous side or the declivous side into the slot.

5 Claims, 4 Drawing Sheets

CHAIN TAB FOR SECURING GATED ENCLOSURES

CROSS REFERENCE TO RELATED APPLICATIONS

This application claims the benefit of U.S. Provisional Application No. 62/461,542 to Studebaker, filed Feb. 21, 2017 and entitled "CHAIN TAB," which is hereby incorporated by reference in its entirety.

BACKGROUND OF THE INVENTION

1. Field of the Invention

Embodiments of the invention described herein pertain to the field of gate closure apparatus. More particularly, but not by way of limitation, one or more embodiments of the invention enable a chain tab for securing gated enclosures.

2. Description of the Related Art

Livestock such as cattle, horses and sheep are often contained within fenced enclosures. The enclosures include gates to allow entry and exit from the enclosure. The gates are typically secured closed using chain tabs. The chain tab is attached to the gate on the opposite side of the gate as the hinge. A chain hangs from the gate below the chain tab. To secure the gate closed, an operator wraps the chain around the adjacent fence post, and then positions the chain into a slot in the chain tab. A conventional chain tab is illustrated in FIG. 1. As shown, the conventional chain tab is shaped like a right triangle and includes a central slot that receives the chain.

A problem that arises is that conventional chain tabs require the person latching the gate to look down in order to hook the chain in the slot in the chain tab. However, the gated enclosure can contain livestock such as bulls, or other dangerous animals or equipment, and it may be unsafe to look away from a dangerous situation when latching the gate, even for a short moment. In addition, placing the chain can be time consuming if the chain is initially wrapped around the chain tab anywhere other than the slot. As shown in FIG. 4, when the chain is placed incorrectly around a conventional chain tab, tension on the chain will not move the chain into the slot or secure the gate, unless the closer looks down and moves the chain into the correct placement. Looking down to position the chain takes time and also diverts the operator's attention from what is occurring inside the enclosure. This lost time may be crucial during a dangerous situation inside the enclosure, such as if a bull is attacking.

Thus, for at least the reasons described above, there is a need for an improved chain tab to reduce the time needed and danger involved in securing gated enclosures.

BRIEF SUMMARY OF THE INVENTION

A chain tab for securing gated enclosures is described.

An illustrative embodiment of a chain tab includes a pair of perpendicular sides meeting at a right angle, a slot extending into the chain tab towards the right angle, the slot dividing the chain tab into a first obtuse triangle and a second obtuse triangle, an obtuse angle of each of the first obtuse triangle and the second obtuse triangle opposing one side of the pair of perpendicular sides, and the right angle opposing a declivous side of the first obtuse triangle and an acclivous side of the second obtuse triangle, the acclivous side and the declivous side each funneling into the slot. In some embodiments, the right angle forms a corner connecting the first obtuse triangle with the second obtuse triangle. In certain embodiments, the declivous side and the acclivous side angle inward towards the slot in a V-shape. In some embodiments, the declivous side forms an obtuse angle with the acclivous side around the slot. In certain embodiments, a centerline of the slot divides the chain tab into the first obtuse triangle and the second obtuse triangle. In some embodiments, the chain tab is symmetric about the centerline. In certain embodiments, the acclivous side and the declivous side funnel a chain wrapping around one of the acclivous side or the declivous side into the slot. In some embodiments, the acclivous side and the declivous side are straight-line, nonparallel surfaces.

An illustrative embodiment of a chain tab system includes a gate including a railing adjacent to a fence post, a chain hanging from the railing, a chain tab attached to the gate proximate to the chain, the chain tab including a pair of sides secured to the gate, the pair of sides meeting at a corner, a slot extending into the chain tab towards the corner, the slot dividing the chain tab into a first obtuse triangle and a second obtuse triangle, the first obtuse triangle and the second obtuse triangle connected together at the corner, the first obtuse triangle including an acclivous side funneling into the slot; and the second obtuse triangle including a declivous side funneling into the slot, wherein the chain wraps around the fence post and mates with the slot by sliding along one of the acclivous side or the declivous side into the slot. In some embodiments, each of an obtuse angle of the first obtuse triangle and an obtuse angle of the second obtuse triangle oppose one side of the pair of sides secured to the gate. In certain embodiments, the first obtuse triangle is formed by the acclivous side, a first side of the pair of sides secured to the gate, and a first edge of the slot, and the second obtuse triangle is formed by the declivous side, a second side of the pair of sides secured to the gate, and a second edge of the slot. In some embodiments, the first edge of the slot and the second edge of the slot converge proximate the corner. In certain embodiments, the acclivous side and the declivous side form a V-shape angling inward towards the slot. In some embodiments, the chain secures the gate closed when the chain is mated with the slot. In some embodiments, the chain tab is secured to the railing above the chain. In some embodiments, the pair of sides form a right angle at the corner. In certain embodiments, tension on the chain funnels the chain into the slot. In some embodiments, the acclivous side and the declivous side are straight-line, nonparallel surfaces.

An illustrative embodiment of an improved chain tab for securing a gated enclosure into a closed position includes a pair of funnel-shaped sides that angle inward in a V-shape towards a chain slot.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of the invention will be more apparent from the following more particular description thereof, presented in conjunction with the following drawings wherein.

Figure 1:
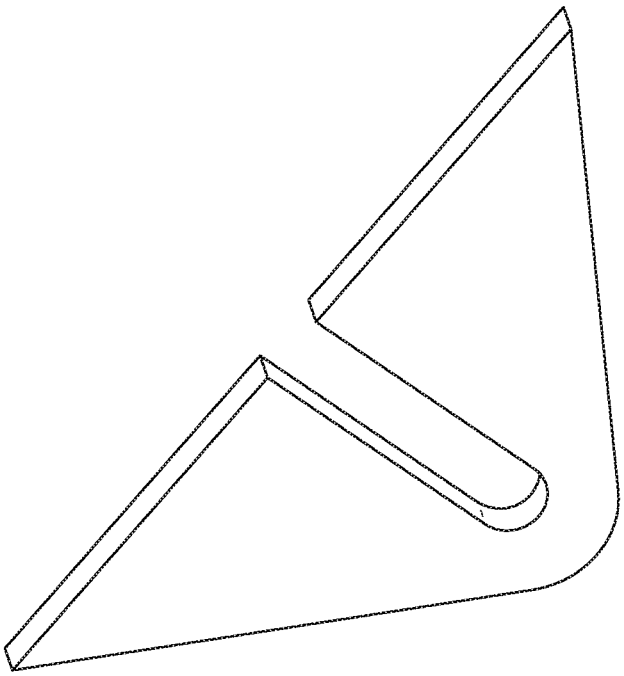
FIG. 1 PRIOR ART
FIG. 1 is a perspective view of a conventional chain tab of the prior art.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

A chain tab for securing gated enclosures will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a railing includes one or more railings.

"Coupled" refers to either a direct connection or an indirect connection (e.g., at least one intervening connection) between one or more objects or components. The phrase "directly attached" means a direct connection between objects or components.

As used herein, illustrative embodiments are primarily described in terms of a gated livestock enclosure, such as a cattle enclosure having a gate and fence formed by steel pipes. However, illustrative embodiments are not so limited and may be applied to any gate that closes using a chain that secures into a chain tab, and may be particularly useful where it is difficult to see the chain tab during closure, such as in the dark, or where it is dangerous to look at the chain tab during closure.

Illustrative embodiments include a chain tab formed by two obtuse triangles separated by a slot. The slot may extend towards a corner of the chain tab, the corner connecting the two obtuse triangles. The acclivous and declivous sides of the obtuse triangles positioned opposite the corner may funnel inward towards the slot similarly to the wings of a stealth bomber or a V-shape. The chain tab of illustrative embodiments may improve the safety of a rancher or other person latching a gate by enabling a chain to be directed into and mated into the slot of the chain tab without the need for the person closing the gate to look down at the chain tab. The chain tab of illustrative embodiments may permit a gated enclosure to be secured into a closed position more expeditiously than conventional chain tabs.

Figure 2:
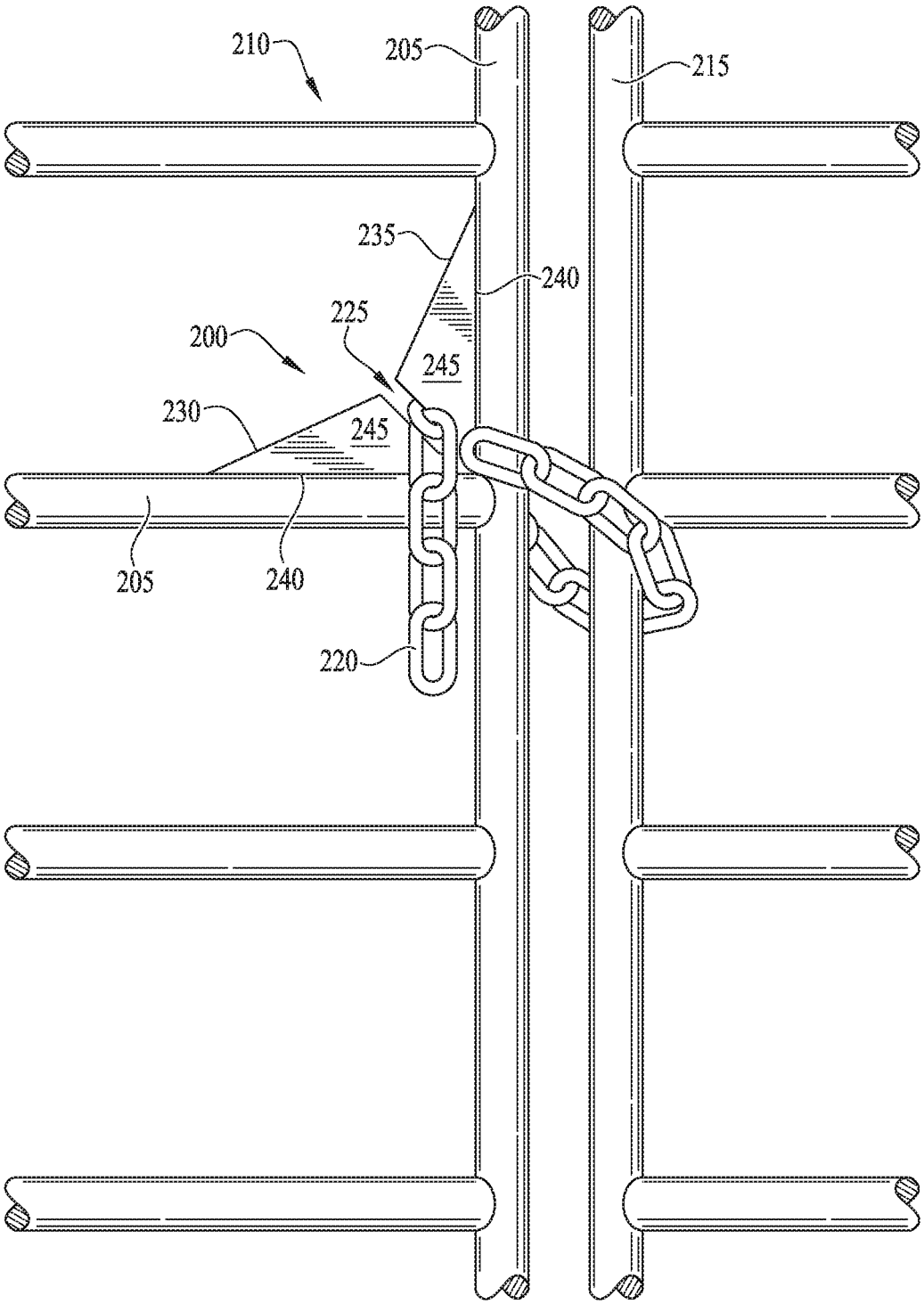
FIG. 2 is a perspective view of a chain tab of an illustrative embodiment securing an exemplary gate in a closed position.

FIG. 2 illustrates a chain tab of an illustrative embodiment securing an exemplary gate closed. Gate 210 may, for example, be a gate of a fenced livestock enclosure such as an enclosure for cattle, may be a gate that encloses animals or equipment from which it may be dangerous to look away, or may be a gate that is closed in the dark or where it is otherwise difficult or inadvisable to see and/or look. Chain tab 200 may be attached to railings 205 of gate 210, adjacent to post 215. Chain 220 may include links, and hang from gate 210 and/or railing 205 next to, below and/or adjacent chain tab 200. Chain 220 may wrap around post 215 and then mate into slot 225 of chain tab 200 to secure gate 210 closed. Chain tab 200 may be neutral as to right-handed or left-handed use. Chain 220 may be centered on gate 210, and an operator may take it around post 215 in either direction with equal ease.

Chain tab 200 may be made of metal such as steel, stainless steel, aluminum, brass or copper, plastic, composite and/or any other material appropriate to withstand the conditions where gate 210 is located and/or exposed, and capable of holding chain 220 so as to secure gate 210 closed against wind, animal weight or pressure, or other gate 210 ambient conditions. Chain tab 200 may be plasma cut and then ground, may be laser cut which may obviate the need for post-fabrication grinding, molded or may be made using another similar fabrication technique.

Chain tab 200 may be secured to gate 210 at and/or by a pair of railing sides 240. Railing sides 240 of chain tab 200 may be straight edges perpendicular to one another, and/or substantially perpendicular, so as to fit in a corner between perpendicular railings 205 and be welded and/or attached to railing 205 on two sides of chain tab 200. Railing sides 240 of chain tab 200 may meet, intersect, converge and/or adjoin at corner 300 (shown in FIG. 3). Slot 225 may extend into chain tab 200 towards corner 300 and divide chain tab 200 into two obtuse triangles 245. The lower obtuse triangle 245 may include acclivous side 230, and the upper obtuse triangle 245 may include declivous side 235. Acclivous side 230 and declivous side 235 may funnel inwards towards slot 225 such that when chain 220 is wrapped around chain tab 200, chain 220 may slide into slot 225 regardless of the location on which chain 220 is initially placed on and/or around chain tab 200, be it on acclivous side 230 or declivous side 235. In some embodiments, acclivous side 230 and declivous side 235 may include beveled and/or ground edges to reduce friction and assist chain 220 in sliding towards slot 225.

One or more railing sides 240 may attach chain tab 200 to railings 205 of gate 210. In some embodiments, chain tab 200 may attach to post 215 adjacent to gate 210, rather than gate 210. In either case, chain tab 200 should be placed such that chain 220 may wrap around both of fence railing 205 and post 215, and then lock, latch and/or mate into slot 225 to hold gate 210 closed. Railing sides 240 of chain tab 200 may be perpendicular to one another so as to fit corner 300 into the space created by the intersection of a horizontal railing 205 and a vertical railing 205 of gate 210 and/or may be oriented such that railing sides 240 of chain tab 200 face railing 205, whereas acclivous side 230 and declivous side 235 face outward away from railing 205. In certain embodiments, chain tab 200 may be at the top of gate 210 and/or only one railing side 240 of chain tab 200 may be attached to railing 205. One or both of railing sides 240 of chain tab 200 may be welded, glued, screwed and/or otherwise attached securely to railing 205.

Figure 3:
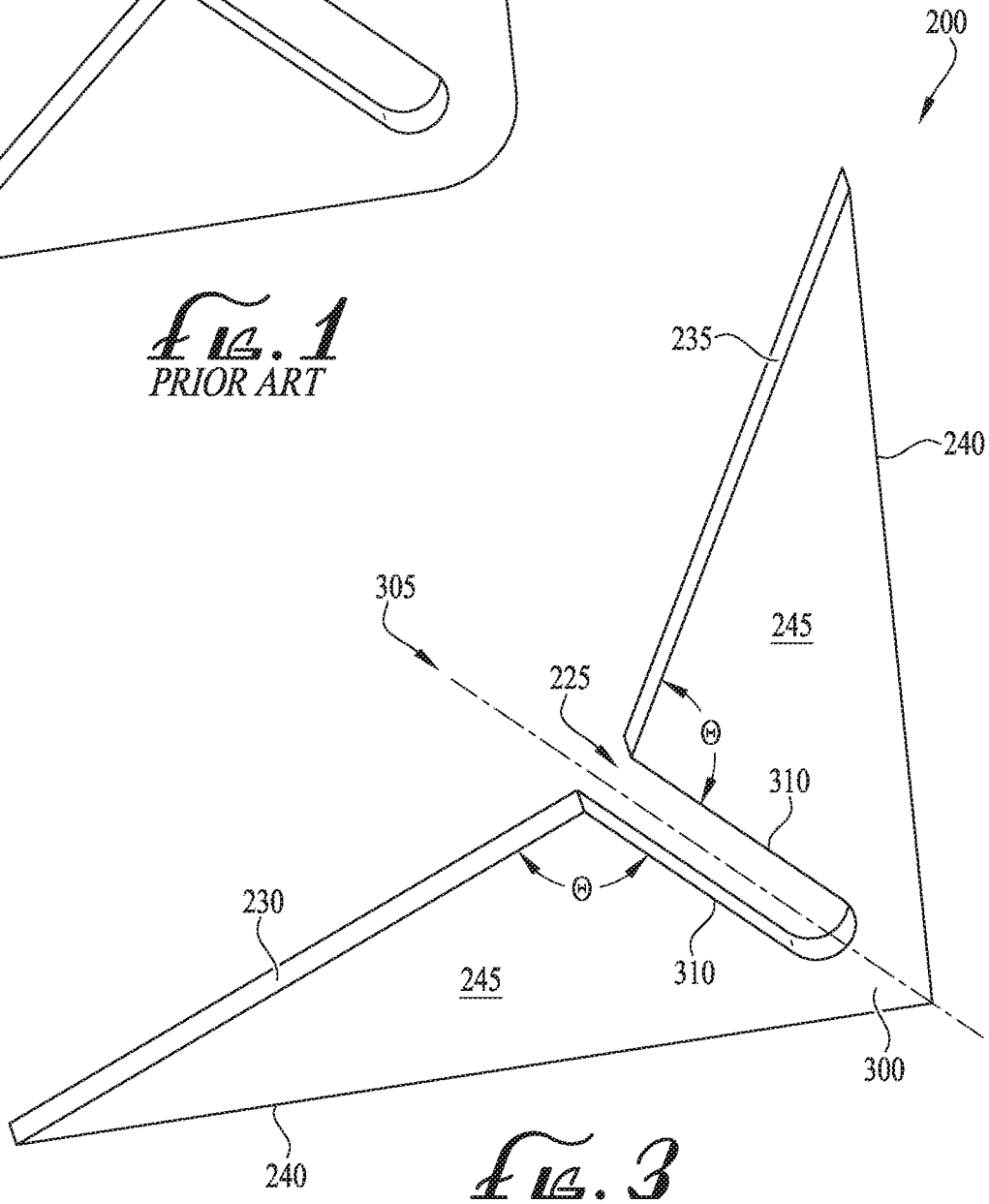
FIG. 3 is a perspective view of a chain tab of an illustrative embodiment.

Turning to FIG. 3, slot 225 may extend centrally into chain tab 200 towards corner 300. Slot 225 may be angled such that slot centerline 305 bisects corner 300 and/or so as to divide chain tab 200 symmetrically around slot centerline 305. Slot 225 may divide chain tab 200 into two obtuse triangles 245 connected together at corner 300. Slot 225 may have its open end on same side of chain tab 200 as acclivous side 230 and declivous side 235. A first obtuse triangle 245 may be formed by horizontal railing side 240, a first slot edge 310 and acclivous side 230, and a second obtuse triangle 245 may be formed by vertical railing side 240, a second slot edge 310 and declivous side 235. First angle Θ formed between acclivous side 230 and first slot edge 310, and second angle Θ formed between declivous side 235 and second slot edge 310, may each be obtuse angles greater than 90° but less than 180°, for example 100°, 110° or 120°. First and second slot edges 310 may converge proximate corner 300 to form a slot 225 shaped to mate with chain 220 and hold chain securely in place within slot 225.

A railing side 240 may oppose each obtuse angle Θ. Acclivous side 230 may angle upward from horizontal railing side 240 towards slot 225, and declivous side 235 may angle downward from vertical railing side 240 towards slot 225. Acclivous side 230 and declivous side 235 may slant inwards towards slot 225 in a V-shape with slot 225 as the center, such that acclivous side 230 is nonparallel with declivous side 235. Obtuse angle Θ and/or slanting of acclivous side 230 and declivous side 235 may form chain tab 200 into a shape similar to wings of a stealth bomber or hang glider and/or form a funnel inwards towards slot 225 and/or corner 300.

Figure 5A:
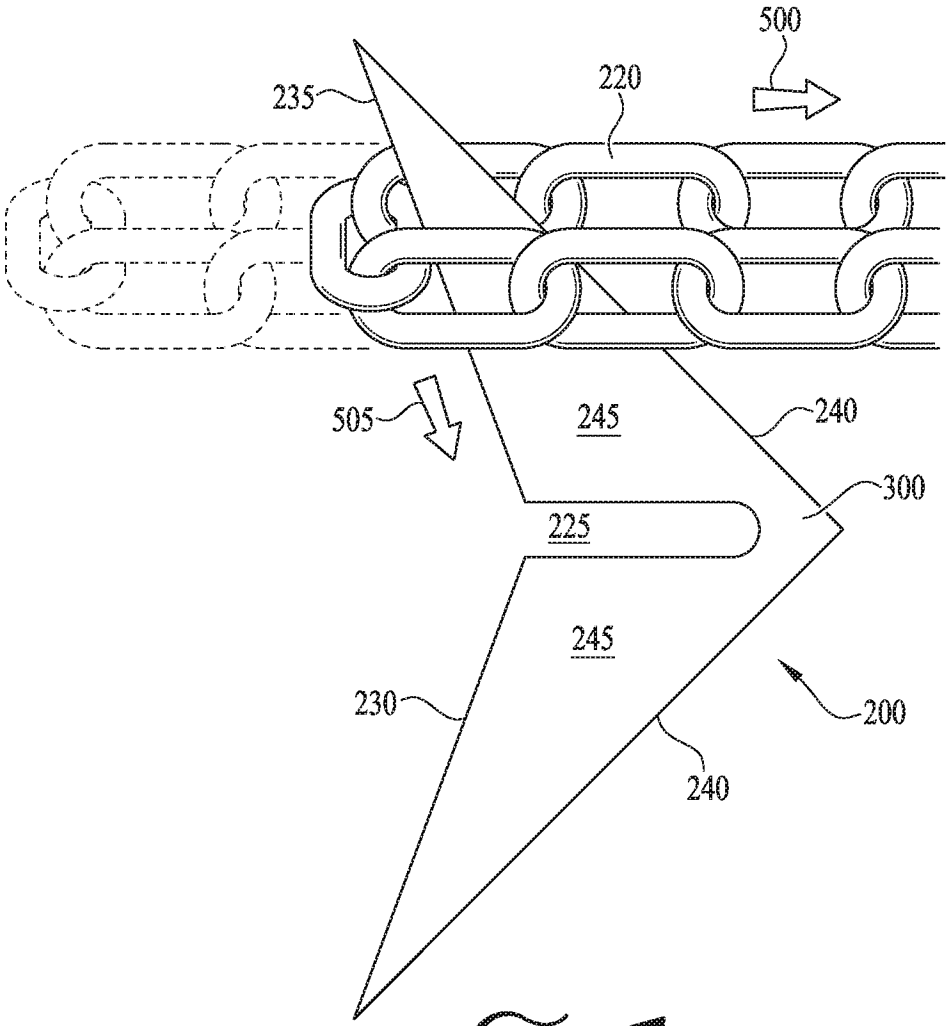
FIGS. 5A-5C are perspective views of a chain tab of an illustrative embodiment with an exemplary chain funneling into a slot of an illustrative embodiment.
Figure 4:
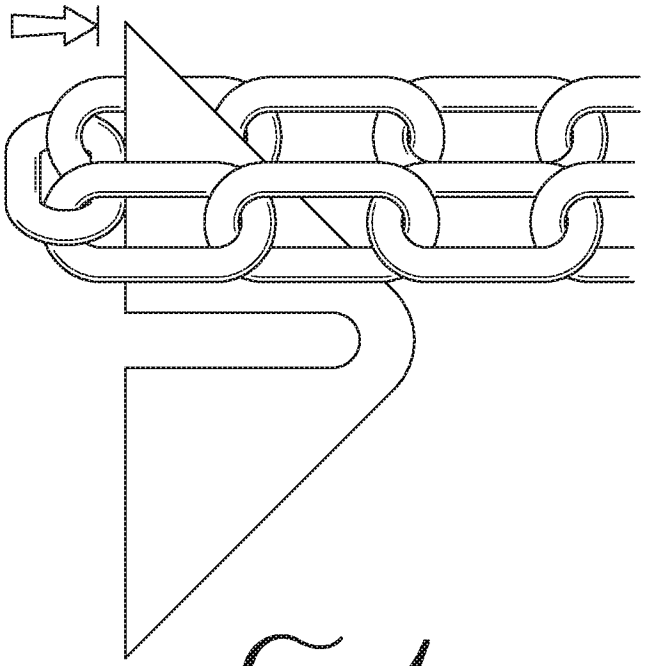
FIG. 4 PRIOR ART
FIG. 4 is a perspective view of a conventional chain tab of the prior art illustrating a chain that has missed the conventional slot and become stuck.
Figure 5C:
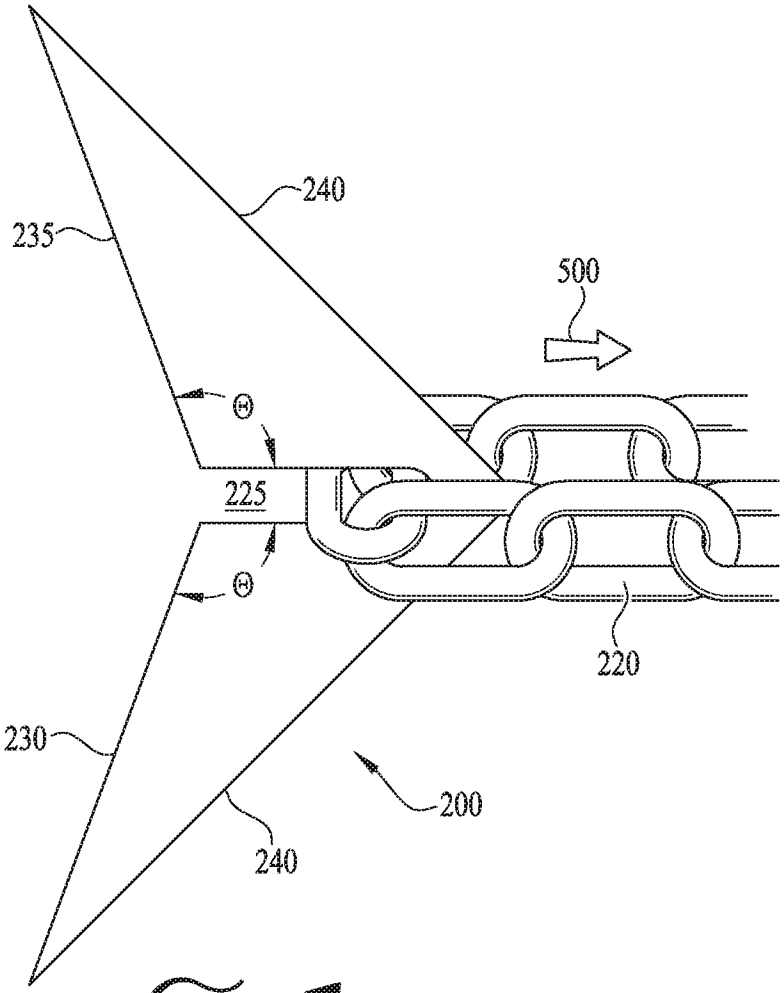
Figure 5B:
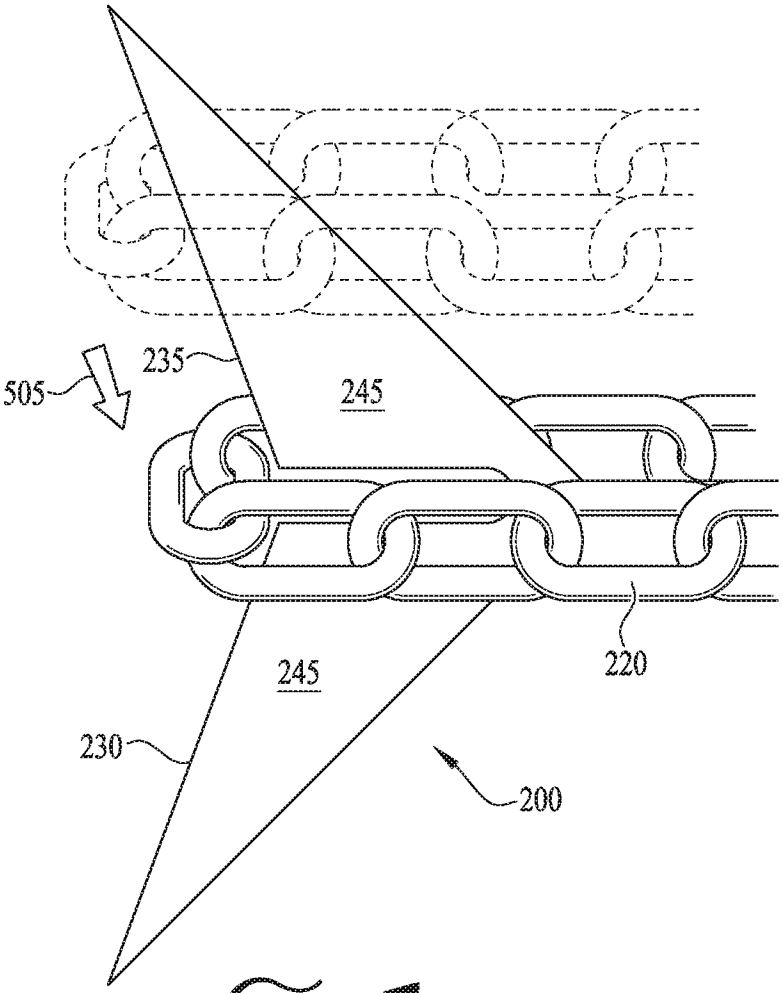

FIGS. 5A-5C illustrate chain 220 funneling into slot 225 of chain tab 200 of illustrative embodiments. FIGS. 5A-5C may be contrasted with conventional chain tab shown in FIG. 4. Unlike the conventional chain shown in FIG. 4 that becomes stuck against the edge of conventional chain tab, chain 220 may funnel towards slot 225 of chain tab 200 regardless of where chain 220 wraps around chain tab 200. Referring to FIG. 5A, chain 220 may be wrapped around chain tab 200 at any location on outer surface of chain tab 200 formed by acclivous side 230 and declivous side 235. For example, chain 220 may be wrapped a distance away from slot 225 if the person closing gate 210 does not look down at chain tab 200 while attempting to lock, latch and/or secure gate 210 closed. Once wrapped, tension may be placed on chain 220 against declivous side 235, as shown by inward arrow 500, towards vertical railing 205 and/or towards post 215, as the closer pulls on chain 220 in order to tie gate 210 and post 215 together using chain 220. Once wrapped and/or tension is placed on chain 220, chain 220 may slide, be directed towards and/or funnel towards slot 225, as illustrated by funneling arrow 505. Turning to FIG. 5B, chain 220 may slide and/or funnel along acclivous side 230 or declivous side 235 until it reaches slot 225. Acclivous side 230 and declivous side 235 may be angled to guide chain 220 into slot 225 with only inward tension 500 against acclivous side 230 or declivous side 235. As shown in FIG. 5B, chain 220 slides down declivous side 235 towards slot 225. Once chain 220 reaches slot 225, chain 220 may fall and/or be guided into slot 225. In FIG. 5C, chain 220 is shown locked and/or mated with slot 225 in chain tab 200 thereby locking and/or latching gate 210 closed.

As illustrated by FIG. 5A-5C, a person closing gate 210 need only pull inward 500 towards post 215 and/or against declivous side 235 (or acclivous side 230) to secure chain 220 within chain tab 200 and/or to funnel chain 220 into slot 225, as the person closing gate 210 may not be aware of the specific location where chain 220 has been placed on chain tab 200. Thus, gate 210 may be secured closed without the need for a person closing gate 210 to look down at chain tab 200, which may save time in closing gate 210 and/or reduce danger to a person closing gate 210.

Illustrative embodiments of a chain tab have been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. A gate of an animal enclosure, comprising:

a gate panel comprising a pair of opposing end posts and a plurality of railings extending therebetween;

a chain tab attached to the gate panel, comprising:

a pair of perpendicular sides meeting at a right angle, one of the perpendicular sides attached to one of the posts, and the other of the perpendicular sides attached to one of the railings;

a slot diagonally extending into an exposed outer surface of the chain tab towards the right angle, the slot comprising a pair of opposing edges and having a centerline which symmetrically divides the chain tab into a first obtuse triangle portion attached to the post and a second obtuse triangle portion attached to the railing, and the right angle forming a corner connecting the first and second obtuse triangle portions;

wherein each of the first and second obtuse triangle portions comprises an obtuse angle opposite a respective one of the pair of perpendicular sides; and wherein the first obtuse triangle portion comprises a declivous side which extends in a first straight line between the post and an opening to the slot, and the second obtuse triangle portion comprises an acclivous side which extends in a second straight line between the railing and the opening, the declivous side and the acclivous side together forming the exposed outer surface of the chain tab and angling inward towards the slot in a V-shape; and a chain hanging adjacent to the chain tab, the chain configured to wrap around an adjacent fence post and mate within the slot of the chain tab thereby securing the gate in a closed position;

wherein the chain tab is configured such that, at any location on the exposed outer surface of the chain tab, the chain slides along one of the acclivous side or the declivous side and funnels towards the slot thereby securing the gate without looking at the chain tab.

2. The ale of claim 1, wherein the declivous side forms an obtuse angle with the acclivous side around the slot.

3. A gate of an animal enclosure, comprising:

a gate panel comprising a pair of opposing end posts and a plurality of railings extending therebetween;

a chain hanging from the gate panel;

a chain tab attached to the gate panel proximate to the chain, the chain tab comprising:

a pair of sides meeting at a right angle corner, one of the sides attached to one of the posts, and the other of the sides attached to the one railing;

a slot diagonally extending into an exposed outer surface of the chain tab towards the corner, the slot comprising a pair of opposing edges and having a centerline which symmetrically divides the chain tab into a first obtuse triangle portion attached to the railing and a second obtuse triangle portion attached to the post, and the first obtuse triangle and the second obtuse triangle connected together at the corner;

wherein each of the first and second obtuse triangle portions comprises an obtuse angle opposite a respective one of the pair of sides;

wherein the first obtuse triangle portion comprises an acclivous side which extends in a first straight line between the railing and an opening of the slot, and the second obtuse triangle portion comprises a declivous side which extends in a second straight line between the post and the opening, the declivous side and the acclivous side together forming the exposed outer surface of the chain tab and forming a V-shape angling inward towards the slot; and wherein the chain is configured to wrap around an adjacent fence post and mate within the slot of the chain tab thereby securing the gate in a closed position, and wherein the chain tab is configured such that, at any location on the exposed outer surface of the chain tab, the chain slides along one of the acclivous side or the declivous side into the slot thereby locking closed the gate without looking at the chain tab.

4. The gate of claim 3 wherein the chain tab is secured to the railing above the chain.

5. The gate of claim 3, wherein tension on the chain funnels the chain into the slot.

* * * * *